US010717057B2

(12) United States Patent
McElligott et al.

(10) Patent No.: US 10,717,057 B2
(45) Date of Patent: Jul. 21, 2020

(54) FLUID MIXING SYSTEM

(71) Applicant: SAINT-GOBAIN PERFORMANCE PLASTICS CORPORATION, Solon, OH (US)

(72) Inventors: Mark McElligott, Hudson, NH (US); Eric T Wyatt, Plymouth, MN (US); Craig R. Maki, Laguna Niguel, CA (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 105 days.

(21) Appl. No.: 15/411,261

(22) Filed: Jan. 20, 2017

(65) Prior Publication Data

US 2017/0225134 A1 Aug. 10, 2017

Related U.S. Application Data

(60) Provisional application No. 62/281,897, filed on Jan. 22, 2016.

(51) Int. Cl.

| | |
|---|---|
| ***B01F 5/10*** | (2006.01) |
| ***B01F 15/00*** | (2006.01) |
| ***B01F 13/00*** | (2006.01) |
| ***B01F 15/02*** | (2006.01) |
| ***B01F 5/12*** | (2006.01) |

(52) U.S. Cl.

CPC ..... *B01F 5/102* (2013.01); *B01F 5/106* (2013.01); *B01F 5/108* (2013.01); *B01F 5/12* (2013.01);

(Continued)

(58) Field of Classification Search

CPC ..... B01F 15/00435; B01F 15/00831; B01F 2015/00584; B01F 5/102; B01F 5/12;

(Continued)

(56) References Cited

U.S. PATENT DOCUMENTS 3,328,255 A * 6/1967 Ilg ..... A61M 1/029 210/710

4,386,634 A 6/1983 Stasz et al.

(Continued)

FOREIGN PATENT DOCUMENTS

CN 1812829 A 8/2006
EP 1087010 A2 3/2001

(Continued)

OTHER PUBLICATIONS

International Search Report for PCT/US2017/014314, International Searching Authority, dated Apr. 18, 2017.

(Continued)

*Primary Examiner* — Tony G Soohoo

(74) *Attorney, Agent, or Firm* — Abel Schillinger, LLP; Chi Suk Kim

(57) ABSTRACT

The present invention is directed to a fluid mixing system. In an embodiment, the fluid mixing system includes a first vessel; a second vessel disposed within the first vessel; a mixer disposed outside of the first vessel in fluid communication with the second vessel; and a media introduction port disposed outside of the first vessel in fluid communication with the mixer.

18 Claims, 2 Drawing Sheets

(52) U.S. Cl.
CPC ..... *B01F 13/0042* (2013.01); *B01F 15/0085* (2013.01); *B01F 15/00435* (2013.01); *B01F 15/00831* (2013.01); *B01F 15/0259* (2013.01); *B01F 2015/00584* (2013.01)

(58) Field of Classification Search
CPC .. B01F 5/108; B01F 15/0259; B01F 13/0042; B01F 15/0085; B01F 5/106
See application file for complete search history.

(56) References Cited

U.S. PATENT DOCUMENTS 5,057,429 A * 10/1991 Watanabe ..... B01F 9/0001 206/213.1
5,362,642 A * 11/1994 Kern ..... B67D 7/0288 222/94
5,772,320 A 6/1998 Hayes
5,941,635 A * 8/1999 Stewart ..... B01F 5/0068 366/165.5
6,494,613 B2 12/2002 Terentiev
6,670,169 B1 12/2003 Schöb et al.
7,438,461 B2 * 10/2008 Schall ..... B65D 88/56 222/145.5
7,810,674 B2 10/2010 Belongia et al.
7,875,448 B2 * 1/2011 Furey ..... C12M 23/28 261/122.1
8,342,737 B2 * 1/2013 Greller ..... B01F 3/04262 366/102
8,602,636 B2 * 12/2013 Kauling ..... B01F 3/04269 366/105
8,647,574 B2 2/2014 Halverson et al.
8,979,357 B1 * 3/2015 Pavlik ..... B01F 13/00 366/197
2002/0105856 A1 * 8/2002 Terentiev ..... B01F 7/0005 366/262
2003/0008389 A1 * 1/2003 Carll ..... B01F 11/0082 435/302.1
2003/0214874 A1 * 11/2003 Hlavinka ..... A61L 2/0011 366/197
2003/0231546 A1 * 12/2003 Bibbo ..... A61L 2/02 366/276
2004/0027912 A1 * 2/2004 Bibbo ..... A61L 2/02 366/149
2004/0027916 A1 * 2/2004 Lafond ..... B01F 11/0065 366/349
2004/0047232 A1 * 3/2004 Terentiev ..... B01F 7/00908 366/273
2004/0062140 A1 * 4/2004 Cadogan ..... B01F 7/18 366/144
2005/0002274 A1 * 1/2005 Terentiev ..... B01F 1/0011 366/273
2005/0073908 A1 * 4/2005 Bibbo ..... A61L 2/02 366/314
2005/0078552 A1 * 4/2005 Zambaux ..... B01F 7/1695 366/241
2005/0249033 A1 * 11/2005 Krause ..... B01F 11/0082 366/332
2006/0280028 A1 * 12/2006 West ..... B01F 7/001 366/331
2007/0064519 A1 3/2007 Neumann
2007/0253287 A1 * 11/2007 Myhrberg ..... B01F 7/162 366/273
2007/0253288 A1 * 11/2007 Mennenga ..... B01F 11/0082 366/274
2007/0263484 A1 * 11/2007 Terentiev ..... B01F 7/162 366/273
2008/0008028 A1 * 1/2008 Terentiev ..... B01F 7/162 366/273
2008/0186802 A1 * 8/2008 Bungay ..... B01F 11/0065 366/142
2009/0142827 A1 * 6/2009 Schoeb ..... B01F 7/00716 435/302.1
2009/0219780 A1 * 9/2009 Castillo ..... B01F 3/1221 366/132
2009/0323466 A1 * 12/2009 Vanhamel ..... B01F 7/001 366/341
2010/0012666 A1 1/2010 Morrissey et al.
2010/0097882 A1 * 4/2010 Uhlenkamp ..... B01F 11/0085 366/243
2010/0149908 A1 * 6/2010 Singh ..... B01F 3/04539 366/276
2010/0172203 A1 * 7/2010 Singh ..... B01F 11/0017 366/239
2010/0260010 A1 * 10/2010 Jornitz ..... B01F 7/0005 366/343
2011/0013473 A1 * 1/2011 Ludwig ..... B01F 3/04269 366/101
2012/0138173 A1 * 6/2012 Cirou ..... B01D 61/18 137/561 R
2012/0155216 A1 * 6/2012 Morrissey ..... B01F 7/162 366/273
2012/0175012 A1 * 7/2012 Goodwin ..... B01F 3/04262 141/11
2012/0177533 A1 * 7/2012 Lee ..... B01F 7/00375 422/38
2012/0218855 A1 * 8/2012 Kunas ..... B01F 7/001 366/150.1
2012/0231504 A1 * 9/2012 Niazi ..... C12M 23/14 435/69.4
2012/0250450 A1 * 10/2012 Ho ..... B01F 5/0268 366/132
2012/0281495 A1 11/2012 Singh et al.
2013/0101982 A1 * 4/2013 Goodwin ..... B01F 7/00691 435/3
2013/0157355 A1 * 6/2013 Barrett ..... C12M 23/14 435/325
2013/0308418 A1 * 11/2013 Cuting ..... B01F 11/0045 366/332
2014/0024105 A1 * 1/2014 Niazi ..... C12M 27/20 435/284.1
2014/0087457 A1 * 3/2014 Goodwin ..... B01F 3/04269 435/325
2014/0091022 A1 * 4/2014 Raiford ..... A61M 1/1668 210/137
2015/0003189 A1 * 1/2015 Werth ..... B01F 7/00858 366/273
2015/0029815 A1 1/2015 Gebauer et al.
2015/0125930 A1 * 5/2015 Gebauer ..... C12M 23/14 435/243
2015/0138913 A1 * 5/2015 Jones ..... B01F 7/001 366/185
2015/0209740 A1 * 7/2015 Lucotte ..... B01F 5/108 366/132
2015/0265986 A1 * 9/2015 Cutting ..... B01F 7/00458 366/265
2015/0265988 A1 * 9/2015 Williams ..... B01F 15/00681 366/204
2015/0306554 A1 * 10/2015 Pavlik ..... B01F 15/00155 366/142
2015/0367302 A1 * 12/2015 Gebauer ..... B01F 13/0818 366/274
2016/0185586 A1 * 6/2016 Showalter ..... B65D 35/28 366/314

FOREIGN PATENT DOCUMENTS

EP 1087010 A3 3/2001
WO 9911352 A1 3/1999
WO 2005115601 A1 12/2005

OTHER PUBLICATIONS

Partial European Search Report (Communication pursuant to Rule 165(1) EPC) for EP 17 74 2002, dated Jul. 26, 2019, 13 pages.

* cited by examiner

FLUID MIXING SYSTEM

CROSS-REFERENCE TO RELATED APPLICATION(S)

This application claims priority under 35 U.S.C. § 119(e) to U.S. Patent Application No. 62/281,897 entitled "FLUID MIXING SYSTEM," by Mark McElligott et al., filed Jan. 22, 2016, which is assigned to the current assignee hereof and incorporated herein by reference in its entirety.

FIELD OF THE DISCLOSURE

The present disclosure relates to fluid mixing systems.

RELATED ART

In certain fluid mixing markets, end users are required to mix media, such as buffer prep, into fluid. Current options include reusable mixers and single use mixing systems. Reusable mixers require extensive cleaning between successive uses—costing time and money. Single use mixing systems require significant expense for each mixing operation, generate high volumes of waste, and are not easy to operate. Industries continue to demand improved fluid mixing systems.

BRIEF DESCRIPTION OF THE DRAWINGS

Embodiments are illustrated by way of example and are not limited in the accompanying figures.

Figure 1:
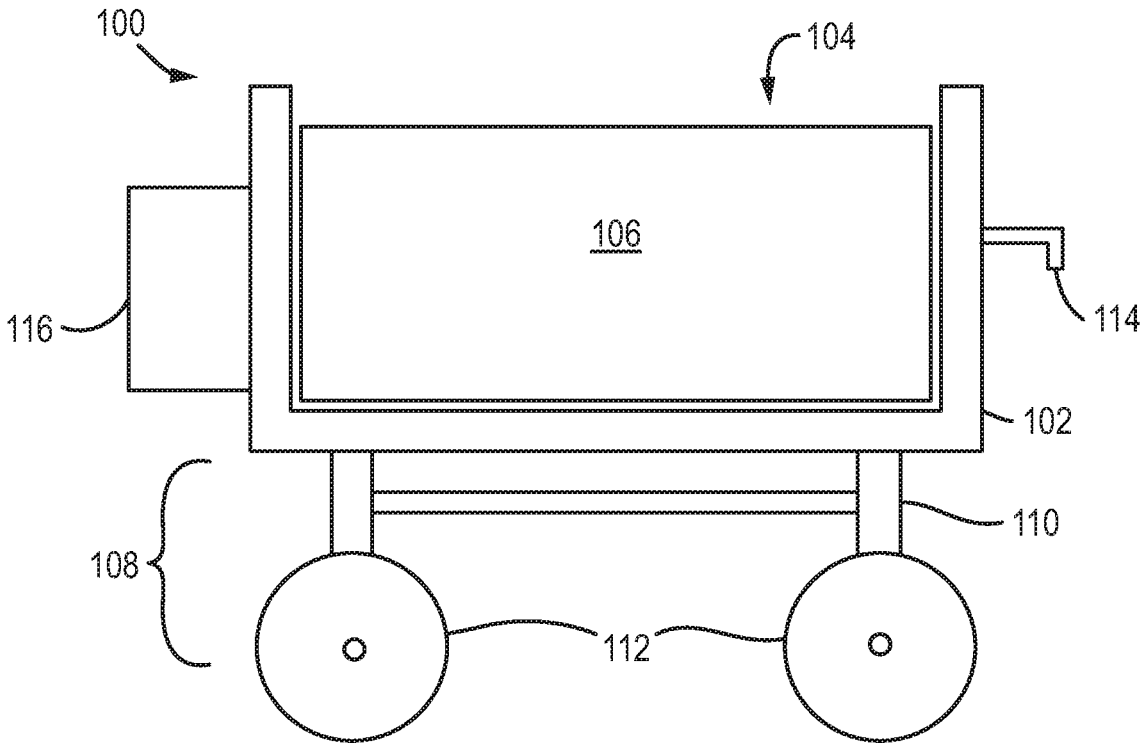
FIG. 1 includes a partially cross-sectional side elevation view of a fluid mixing assembly in accordance with an embodiment.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the fluid mixing arts.

Fluid mixing systems in accordance with embodiments described herein may permit desirable fluid mixing while reducing cost, expense, and difficulty associated with traditional reusable and single-use mixing systems. In accordance with an embodiment, fluid mixing systems can include a first vessel defining an interior volume. A second vessel may be disposed within the interior volume of the first vessel. The second vessel can have a shape similar, such as identical, to the interior volume of the first vessel. The second vessel can hold fluid to be mixed. In an embodiment, while the first vessel may be part a reusable portion of the fluid mixing system, the second vessel may be single-use, offsetting cleaning costs while minimizing the number of single-use parts that require replacement between successive uses.

In an embodiment, at least one fluid conduit, such as a first fluid conduit and a second fluid conduit, extends between the second vessel and a mixer disposed outside of the first vessel, fluidly coupling the mixer to the second vessel. A media introduction port can be disposed along one of the fluid conduits to facilitate introduction of a media to the fluid. In a particular embodiment, the media introduction port is positioned between an inlet port of the mixer and the interior volume of the first vessel. That is, the mixer can be positioned along the fluid conduit such that media is introduced to the mixer prior to coming into contact with fluid inside the second vessel. Fluid mixing systems in accordance with embodiments herein may permit desirable mixing characteristics of a media into a fluid while simultaneously offering a cost effective, time efficient solution.

Referring initially to FIG. 1, a fluid mixing system 100 can generally include a first vessel 102 defining an interior volume 104. The first vessel 102 can be part of a reusable portion of the fluid mixing system 100. In an embodiment, the first vessel 102 can include a non-disposable material adapted for multiple uses. In a particular embodiment, the first vessel 102 can include a rigid material such as, for example, a metal, an alloy, a rigid polymer, ceramic, another reusable material, or any combination thereof. In a particular embodiment, the first vessel 102 can include, such as consist essentially of, steel. More particularly, the first vessel 102 can include, such as consist essentially of, stainless steel. Surface treatment or one or more coatings can be applied to the first vessel 102, enhancing characteristics thereof for minimization of bacterial growth and other unfavorable developments. In an embodiment, the first vessel 102 includes an aperture into an interior volume thereof. In an embodiment, the aperture defines a side surface of the first vessel. In an example, the first vessel 102 is open along at least one face thereof.

In an embodiment, the first vessel 102 can be coupled to an underlying structure 108 which can optionally include supports 110, wheels 112, handles 114, other suitable elements permitting movement of the fluid mixing system 100, or any combination thereof. One or more devices 116, such as sensors, outlet control units, and temperature control units such as heaters and chillers may be attached to the fluid mixing system 100, such as along an exterior portion of the first vessel 102. The device 116 can also be attached to the underlying structure 108 or be utilized as a stand alone unit which can be selectively coupled to a component of the fluid mixing system 100. Wires, cables, conduits, or other connections can extend from the device 116 to the first vessel 102.

In an embodiment, the interior volume 104 of the first vessel 102 can have any reasonable configuration such as, for example, a generally polygonal cross-sectional shape. For example, the interior volume 104 can be a generally polyhedral, such as polyhedral, having polygonal faces connected together at vertices. In a particular embodiment, the interior volume 104 can include a uniform polyhedral such as a tetrahedron, a prism, a cube, or another suitable shape. In another embodiment, the interior volume 104 can have an arcuate, rounded, or generally curvilinear profile, such as for example, an ellipsoid or a spherical, or generally spherical, shape. The interior volume 104 can have any reasonable volumetric capacity such as, for example, a volumetric capacity of at least 1 liter (L), at least 10 L, at least 50 L, at least 100 L, at least 500 L, or at least 1000 L. The volumetric capacity can be less than 10,000 L, less than 5000 L, less than 2500 L, less than 2000 L, less than 1500 L, or less than 1000 L. Moreover, the volumetric capacity can be in a range between and including any of the values described above, such as for example, between 10 L and 5000 L, between 10 L and 1000 L, between 100 L and 750 L, or between 200 L and 500 L. It will be appreciated that the volumetric capacity of the interior volume 104 can be between any of the minimum and maximum values noted above.

A second vessel 106 can be positioned within the interior volume 104. The second vessel 106 may be removably positioned within the interior volume 104. In an embodiment, the second vessel 106 has a volume similar to the volume of the first vessel 102. In another embodiment, the second vessel 106 has a volume different from the volume of the first vessel 102. In an embodiment, the second vessel 106 can occupy all, or substantially all, of the interior volume 104 when fully filled. In another embodiment, the second vessel 106 occupies less than 99% of the interior volume 104, such as less than 95% of the interior volume 104, less than 90% of the interior volume, less than 75% of the interior volume, or less than 50% of the interior volume. The second vessel 106 can be optionally coupled to the interior volume 104 of the first vessel 102 by one or more securing elements such as cables, cords, hooks, fasteners, adhesive (or semi-adhesive) material, any other suitable connection type, or a combination thereof. In an embodiment, the second vessel 106 can be temporarily coupled to the interior volume 104 while empty. Upon introduction of fluid into the second vessel 106, detachment can occur, causing the first and second vessels 102 and 106 to separate from one another. Temporary attachment between the first and second vessels 102 and 106 can permit easier filling of the second vessel.

In a particular embodiment, the second vessel 106 can include a flexible material such as a polymer. The second vessel shape can be preformed to be similar to that of the first vessel 102, however, the material may collapse for storage and discard. In a particular instance, the second vessel 106 can have a sidewall thickness of at least 0.1 mm, at least 0.5 mm, at least 1 mm, or at least 5 mm. In another embodiment, the second vessel 106 can have a sidewall thickness of no greater than 10 mm, or no greater than 6 mm. In a further embodiment, the sidewall thickness can be in a range between and including any of the values described above, such as between 0.5 mm and 5 mm, or between 1 mm and 2 mm. It will be appreciated that the sidewall thickness can be between any of the minimum and maximum values noted above.

In a particular instance, the second vessel 106 can be fully enclosed such that an interior volume thereof is fully surrounded, or substantially fully surrounded, by material. In an embodiment, the second vessel 106 can be reflectively symmetrical, generally reflectively symmetrical, or even invertible such that insertion into the first vessel 104 can occur in multiple different orientations. In another embodiment, the second vessel 106 is not reflectively symmetrical or cannot be inserted into the first vessel 104 in multiple different orientations. The second vessel 106 can include ports or openings permitting fluid communication of the interior volume thereof with an external environment. In an embodiment, the second vessel 106 can include at least one port, such as at least two ports, at least three ports, or at least four ports. In a particular embodiment, the second vessel 106 can include five ports. In a further embodiment, the second vessel 106 can include no more than 10 ports, no more than 8 ports, or no more than 6 ports. In another embodiment, the second vessel 106 can include a number of ports within a range between and including any of the values described above, such as between two ports and ten ports, or between four ports and 6 ports. The ports can form inlets and outlets, connecting the interior volume of the second vessel 106 with the external environment. The ports can be positioned along any surface of the second vessel 106, such as along a top surface, one or more side surfaces, or a bottom surface. By way of a non-limiting example, inlet ports may be disposed along the top surface of the second vessel 106 while outlet ports are disposed along a side surface or bottom surface thereof. This can prevent aspiration which might occur when the interior volume of the second vessel 106 includes a gaseous component. The ports can optionally include covers which prevent fluid drainage when disconnected from respective conduits or apparatuses.

Figure 2:
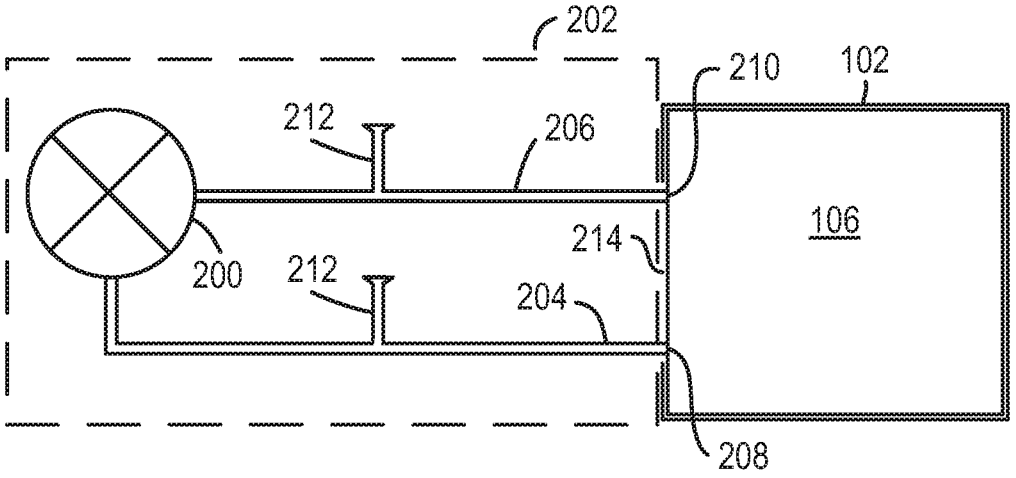
FIG. 2 includes a schematic of a fluid mixing assembly in accordance with an embodiment.

Referring to FIG. 2, the fluid mixing assembly can further include a mixer 200 disposed in an external environment 202 relative to the first and second vessels 102 and 106. The mixer 200, or at least a portion thereof, can be coupled to the first vessel 102, the underlying structure 108, or a separate, detached element spaced apart from the first vessel 102. In an embodiment, the mixer 200, or at least a portion thereof, can be attached to the second vessel 106 by one or more fluid conduits, such as a first fluid conduit 204 and a second fluid conduit 206. The first fluid conduit 204 can extend between a port 208 of the second vessel 106 and an inlet port of the mixer 200. The second fluid conduit 206 can extend between a port 210 of the second vessel 106 and an outlet port of the mixer 200. In this regard, fluid can exit the second vessel 106 through port 208, travel through the first fluid conduit 204, and enter the mixer 200. Upon ejection from the mixer 200, the fluid can travel through the second fluid conduit 206 to the port 210 of the second vessel 106, reentering the interior volume of the second vessel 106. In an embodiment, the first fluid conduit 204 and second fluid conduit 206 both or independently include a material different than a material of the second vessel 106 or include a material similar or the same as a material of the second vessel 106. In an embodiment, the first fluid conduit 204 and second fluid conduit 206 both or independently are unitary with the second vessel 106. In an alternative embodiment, the first fluid conduit 204 and second fluid conduit 206 both or independently include discrete components coupled to the second vessel 106.

In an embodiment, media can be introduced to the fluid directly within the interior volume of the second vessel 106. That is, media can be introduced through a port which directly connects with the interior volume of the second vessel 106 without any intermediary element therebetween. In another embodiment, media introduction can occur at a location external to the second vessel 106. For example, media can be introduced along one of the first or second fluid conduits 204 or 206. Alternatively, media can be introduced along both the first and second fluid conduits 204 and 206. Introduction of media external to the second vessel 106 can enhance mixing properties and accelerate the rate of mixing, thereby reducing time spent to reach homogenous composition characteristics. For example, introduction of media in the first fluid conduit 204, before the fluid reaches the mixer 200, can create an accelerated mixing rate. Combined with turbulent fluid at the mixer 200, the media can more readily diffuse through the fluid, creating a homogenous mixture. To the contrary, media introduction directly into the interior volume of the second vessel 106 (i.e., without first encountering the mixer 200) may result in media settling, such as the aggregate buildup of media along a wall of the second vessel 106. Further, media introduced, for example, at a location away from the port 208 may not immediately be pulled into the first fluid conduit 204, but rather may reside within the fluid, suspended therein but unmixed. This increases mixing time by reducing mixing efficiency.

Media introduction can occur through one or more media introduction ports 212 disposed along one or both of the first or second fluid conduits 204 or 206. A media introduction port 212 can be disposed along first fluid conduit 204, second fluid conduit 206, or combination thereof. The media introduction port 212 can extend from the first or second fluid conduit 204 or 206, having an aperture for introduction of media. Any configuration of the media introduction port is envisioned. For instance, the media introduction port can have a tapered interface which expands the opening size of the media introduction port 212, facilitating increased area into which media can be introduced. In an embodiment, the media introduction port 212 can be integrally formed with the first or second fluid conduit 204 or 206. That is, the media introduction port 212 can be part of the first or second fluid conduit 204 or 206. In another embodiment, the media introduction port 212 can be detachable from the first or second fluid conduit 204 or 206. For example, the media introduction port 212 can be held to the first or second fluid conduit 204 or 206 by one or more fasteners, such as clamps, threaded fasteners, non-threaded fasteners, a bayonet connection, an adhesive, a mechanical deformation, another suitable method, or a combination thereof. In certain embodiments, removability of the media introduction port 212 permits cleaning thereof in the event of media clog resulting from introduction media too quickly.

The media introduction port 212 can be adapted to receive wet media, dry media such as powders, or a combination thereof. In a particular embodiment, the media introduction port 212 can include a venturi. The media introduction port 212 can include a cover (not illustrated) preventing contamination of the fluid being mixed. In an embodiment, the cover can be penetrated by a trocar or needle which can be part of a fluid introduction assembly. In another embodiment, the cover can be removable, such as by hinge or translating structure, exposing the inner volume of the media introduction port 212 for introduction of media. Use of a cover can reduce contamination of the fluid from airborne particulate, debris, and biologicals.

One or more apertures 214 on the first vessel 102 can permit access between the interior volume 104 of the first vessel 102 and the external environment 202. The fluid conduits 204 and 206 can extend through the one or more apertures 214, connecting the second vessel 106 to the mixer 200. The one or more apertures 214 can include openings extending through the thickness of the first vessel 102. In an embodiment, the one or more apertures 214 can be selectively closed by a cover (not illustrated), such as for example, by a door, a hatch, or another suitable cover element. The cover can close the interior volume 104 of the first vessel 102, for example, to clean, transport, or store the first vessel 102. In an embodiment, the one or more apertures 214 can have dimensions generally equal to the dimensions of the fluid conduits 204 and 206. In another embodiment, the one or more apertures 214 can be larger than the fluid conduits 204 and 206, permitting passage of further conduits or accessories into the first vessel 102. Each fluid conduit 204 and 206 can extend through the same aperture or through different apertures along the first vessel 102. Grommets may be used around the fluid conduits 204 and 206 within the one or more apertures 214 to create a better seal in the event of leakage of fluid from the second vessel 106.

In a particular instance, the second vessel 106, at least a portion of the mixer 200, and the first and second fluid conduits 204 and 206 can form a closed-unit, disposable mixing assembly. The closed-unit disposable mixing assembly can be single-use, such that after a mixing operation is complete and the fluid is optionally drained, the closed-unit disposable mixing assembly can be discarded as one unit. In an embodiment, the closed-unit, disposable mixing assembly can be removed from the first vessel 102 as a single, closed piece. That is, the entire closed-unit, disposable mixing assembly can be removed without soiling the first vessel 102 and without requiring detachment of multiple components. This allows for less downtime between successive mixing operations and minimizes time and cost to clean a portion of the assembly between uses. Further, because the second vessel 106, the portion of the mixer 200, and the first and second fluid conduits 204 and 206 form a closed-unit, disposal of potentially hazardous or deleterious fluids can be done with minimal mess and human contact.

Figure 3:
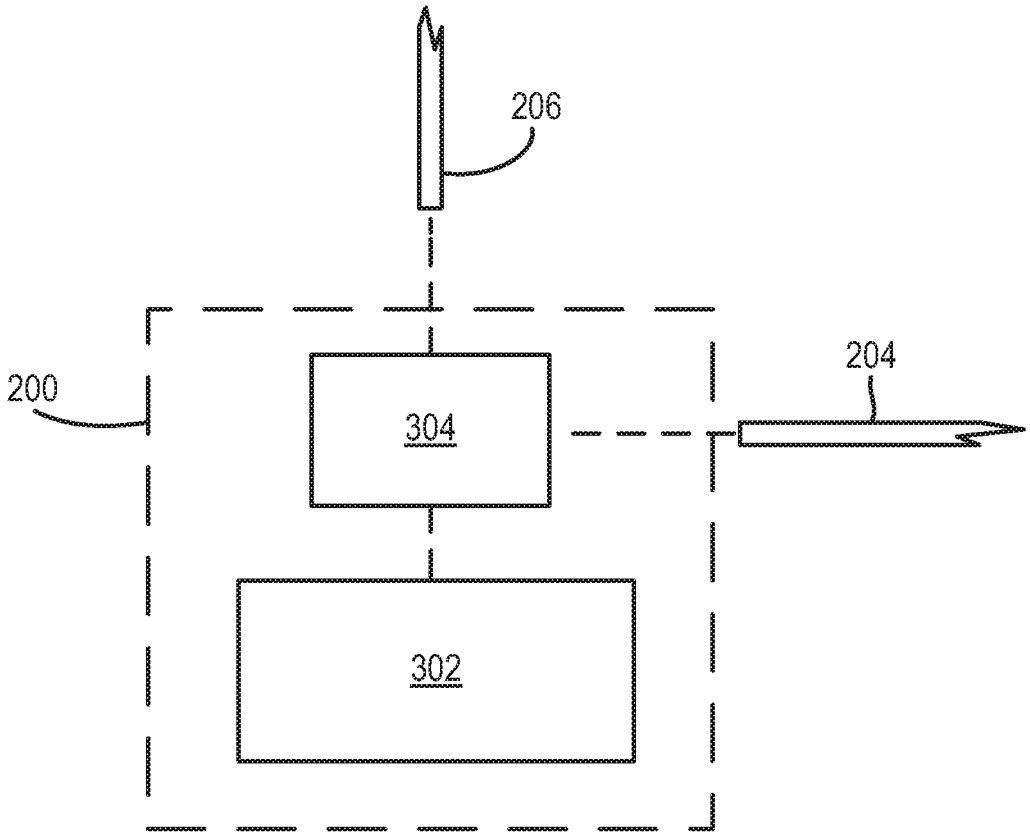
FIG. 3 includes a schematic of a mixer for a fluid mixing system in accordance with an embodiment.

FIG. 3 includes an exploded view of an exemplary mixer 200. The mixer 200 can include several portions such as a reusable portion 302 and a disposable portion 304. The reusable portion 302 may be coupled to another part of the fluid mixing system 100 such as an exterior surface of the first vessel 102 while the disposable portion 304 is coupled to the reusable portion 302. In an embodiment, the reusable portion 302 can include a driving unit, such as a motor, which provides a biasing force to the disposable portion 304. By way of example, the motor can include a direct current (DC) motor or an alternating current (AC) motor. Exemplary DC motors include brush motors and brushless motors. AC motors include induction motors, synchronous motors, and linear motors. Other motors can be used as the above list of motors is intended to be exemplary.

The disposable portion 304 of the mixer 200 can be in fluid communication with the first and second fluid conduits 204 and 206. The disposable portion 304 can include a pump head with a pumping element adapted to provide a positive fluid pressure along the second fluid conduit 206. In an embodiment, the pump head can be a centrifugal style pump, such as an impeller. The impeller can be driven by the driving unit of the reusable portion 302, for example through magnetic coupling, shaft rotation, or a combination thereof. That is, the drive unit of the reusable portion 302 of the mixer 200 can power the pump head.

In an embodiment, the disposable portion 304 of the mixer 200 can engage with the reusable portion 302 through a bayonet or threaded connection. In another embodiment, the disposable portion 304 and reusable portion 302 can engage one another by a threaded or nonthreaded fastener, a collet system, or one or more bands, clamps, or nuts. In a further embodiment, the disposable portion 304 can engage with the reusable portion 302 by any other available attachment method or fastener, or through a combination of the previously described methods.

During installation of the closed-unit, disposable mixing assembly with the first vessel 102, the disposable portion 304 can be routed to the reusable portion 302 of the mixer 200 and engaged therewith. After successfully connecting the reusable portion 302 with the disposable portion 304, the mixer 200 can be powered and engaged, causing the pump head within the reusable portion 302 to generate a bias along the fluid conduits 204 and 206.

Fluid mixing systems 100 in accordance with embodiments described herein can increase mixing efficiency not only by minimizing cost and labor involved in preparing the fluid mixing system 100 between successive mixing operations, but also by accelerating mixing of media into fluid. In an embodiment, the fluid mixing system is adapted to have a 2× fold increase in no greater than 60 seconds and a 4× fold increase in no greater than 120 seconds, as measured according to the Mixing Test.

As used herein, the Mixing Test compares target concentration to starting concentration of an additive to fluid. To initiate the test, a vessel is half filled with water and heated to testing temperature (e.g., 135° F.). The chemical to be mixed (e.g., NaCl) is added to the vessel along with water to fill the vessel. Mixing is initiated until homogenous dispersal is reached. Time to achieve homogenously dispersal of the chemical relative to the fluid is recorded and the test is repeated using different conditions. A 2× fold increase signifies a 2-time increase in concentration of the chemical from the starting concentration to the target concentration. For example, a starting concentration of 2 g/L has a 2× fold increase when the target concentration is 4 g/L. A starting concentration of 4 g/L has a 2× fold increase when target concentration is 8 g/L. Similarly, a 4× fold increase signifies a 4-time increase in concentration of the chemical from starting concentration to target concentration. For example, a starting concentration of 2 g/L has a 4× fold increase when the target concentration is 8 g/L. A starting concentration of 8 g/L has a 4× fold increase when the target concentration is 83 g/L. Testing is performed under the Mixing Test varying conditions such as mixing temperature of the fluid, vessel size, fluid volume, pump speed, and vessel shape. For each test, mixing time until target concentration is reached is recorded.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Embodiment 1. A fluid mixing system including a first vessel; a second vessel disposed within the first vessel; a mixer disposed outside of the first vessel in fluid communication with the second vessel; and a media introduction port disposed outside of the first vessel in fluid communication with the mixer.

Embodiment 2. A fluid mixing system including a first vessel; a mixer disposed outside of the first vessel, wherein the mixer includes an inlet port and an outlet port; a first fluid conduit extending between the inlet port of the mixer and an interior volume of the first vessel; a second fluid conduit extending between the outlet port of the mixer and the interior volume of the first vessel; and a media introduction port disposed along the first fluid conduit.

Embodiment 3. A fluid mixing system including a first vessel defining an interior volume adapted to receive a second vessel; and a mixer disposed outside of the first vessel and adapted to be in fluid communication with an interior volume of the second vessel, wherein the mixer includes a reusable portion and a disposable portion.

Embodiment 4. The fluid mixing system of any one of the preceding embodiments, wherein the first vessel is reusable, wherein the first vessel includes a rigid material, wherein the first vessel includes metal, wherein the first vessel includes steel, such as stainless steel, wherein the first vessel includes an aperture into an interior volume thereof, wherein the aperture defines a side surface of the first vessel, or wherein the first vessel is open along at least one face thereof.

Embodiment 5. The fluid mixing system of any one of the preceding embodiments, further including a second vessel adapted to be disposed within the first vessel, wherein the second vessel is disposable, wherein the second vessel includes a flexible material, wherein the second vessel includes a polymer, or wherein the second vessel includes at least two ports, at least three ports, at least four ports, or at least five ports.

Embodiment 6. The fluid mixing system of embodiment 5, wherein the second vessel, at least a portion of the mixer, and conduits extending between the second vessel and the mixer form a closed-unit, disposable mixing assembly.

Embodiment 7. The fluid mixing system of embodiment 6, wherein the closed-unit disposable mixing assembly is removable from the first vessel as a single piece.

Embodiment 8. The fluid mixing system of embodiment 5, wherein the second vessel has a shape corresponding to a shape of the first vessel, wherein the second vessel has a shape different from a shape of the first vessel, or wherein the second vessel includes a shape selected from the group consisting of a cylinder, a spheroid, a cone, and a polyhedron such as a prism.

Embodiment 9. The fluid mixing system of any one of the preceding embodiments, wherein the first vessel is disposed on a movable structure, wherein the first vessel has an interior volume of at least 10 L, at least 50 L, at least 100 L, or at least 500 L, wherein the first vessel has an interior volume of no greater than 5000 L, no greater than 2000 L, or no greater than 1500 L, wherein the second vessel has a volume of at least 10 L, at least 50 L, at least 100 L, or at least 500 L, wherein the second vessel has a volume of no greater than 5000 L, no greater than 2000 L, or no greater than 1500 L, wherein the interior volume of the first vessel is substantially the same as the volume of the second vessel, or wherein the interior volume of the first vessel is different from the volume of the second vessel.

Embodiment 10. The fluid mixing system of any one of the preceding embodiments, further comprising a media introduction port, wherein the media introduction port is disposed along a fluid conduit extending between an inlet port of the mixer and an interior volume of the first vessel, wherein the media introduction port comprises a venturi tube, wherein the media introduction port is adapted to receive a media to be mixed with a fluid contained in the first vessel, or wherein the media introduction port is adapted to receive a wet media, a dry media, or a combination thereof.

Embodiment 11. The fluid mixing system of any one of embodiments 1, 2, and 4-10, wherein the mixer includes a reusable portion and a disposable portion, wherein the reusable portion is coupled to the first vessel, wherein the disposable portion is coupled to the second vessel, wherein the reusable portion includes a driving unit such as a motor, wherein the disposable portion includes a pump head such as a centrifugal pump head.

Embodiment 12. The fluid mixing system of any one of the preceding embodiments, wherein the fluid mixing system is adapted to have a 2× fold increase in no greater than 60 seconds and a 4× fold increase in no greater than 120 seconds, as measured according to the Mixing Test.

Embodiment 13. The fluid mixing system of any one of the preceding embodiments, wherein the mixer is coupled to the second vessel by a first fluid conduit extending between the outlet of the second vessel and the mixer and a second fluid conduit extending between the inlet of the second vessel and the mixer, wherein the first and second fluid conduits comprise materials different than a material of the second vessel or wherein the first and second fluid conduits comprise materials similar or the same as a material of the second vessel, wherein the first and second fluid conduits are unitary with the second vessel or wherein the first and second fluid conduits comprise discrete components coupled to the second vessel.

Embodiment 14. The fluid mixing system of embodiment 13, wherein at least one of the first and second fluid conduits is removably coupled to the mixer, wherein a media introduction port is disposed along the first fluid conduit, or combination thereof.

Embodiment 15. A fluid mixing system including a disposable vessel including an inlet and an outlet; a disposable portion of a mixer disposed outside of the disposable vessel, the disposable portion of the mixer adapted to couple with a reusable portion of the mixer; a first fluid conduit extending between the inlet of the disposable vessel and the disposable portion of the mixer; and a second fluid conduit extending between the outlet of the disposable vessel and the disposable portion of the mixer, wherein the fluid mixing system is adapted for single use, wherein the fluid mixing system is adapted to be used with a reusable vessel, and wherein the reusable portion of the mixer is coupled to the reusable vessel.

Embodiment 16. The fluid mixing system of embodiment 15, wherein the disposable vessel is adapted to be positioned within the reusable vessel prior to a mixing operation, wherein the disposable vessel includes a material different from a material of the reusable vessel, or wherein the disposable vessel has a shape corresponding to a shape of the reusable vessel.

Embodiment 17. The fluid mixing system of any one of embodiments 15 and 16, wherein the disposable vessel includes a flexible material, wherein the disposable vessel includes a polymer, or wherein the disposable vessel includes at least two ports, at least three ports, at least four ports, or at least five ports.

Embodiment 18. The fluid mixing system of any one of embodiments 15-17, wherein the disposable vessel, at least a portion of the disposable portion of the mixer, and the conduits extending between the disposable vessel and the disposable portion of the mixer form a closed-unit, disposable mixing assembly.

Embodiment 19. The fluid mixing system of embodiment 18, wherein the closed-unit disposable mixing assembly is removable from the reusable vessel as a single piece.

Embodiment 20. The fluid mixing system of embodiment 18, wherein the disposable vessel has a shape corresponding to a shape of the reusable vessel, wherein the disposable vessel has a shape different from a shape of the reusable vessel, or wherein the disposable vessel includes a shape selected from the group consisting of a cylinder, a spheroid, a cone, and a polyhedron such as a prism.

Embodiment 21. The fluid mixing system of any one of embodiments 15-20, wherein the fluid mixing system is adapted to have a 2× fold increase in no greater than 60 seconds and a 4× fold increase in no greater than 120 seconds, as measured according to the Mixing Test.

Note that not all of the activities described above in the general description or the examples are required, that a portion of a specific activity may not be required, and that one or more further activities may be performed in addition to those described. Still further, the order in which activities are listed is not necessarily the order in which they are performed.

Certain features that are, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A fluid mixing system comprising:

a first vessel;

a second vessel disposed within the first vessel;

a mixer disposed outside of the first vessel in fluid communication with the second vessel, wherein the mixer includes an inlet port and an outlet port;

wherein a first fluid conduit extends between the inlet port of the mixer and an interior volume of the first vessel;

and a second fluid conduit extends between the outlet port of the mixer and the interior volume of the first vessel; and a media introduction port for introduction of a media into a fluid in the fluid mixing system, wherein the media introduction port comprises a venturi, the media introduction port disposed outside of the first vessel in fluid communication with the mixer, wherein the media introduction port is disposed on the first fluid conduit, the second fluid conduit, or combination thereof.

2. The fluid mixing system of claim 1, wherein at least one of the first and second fluid conduits is removably coupled to the mixer.

3. The fluid mixing system of claim 1, wherein the first vessel is reusable.

4. The fluid mixing system of claim 1, wherein the second vessel is disposable.

5. The fluid mixing system of claim 1, wherein the second vessel, at least a portion of the mixer, and at least one of the first and second fluid conduits form a closed-unit, disposable mixing assembly.

6. The fluid mixing system of claim 1, wherein the second vessel has a shape corresponding to a shape of the first vessel or wherein the second vessel has a shape different from a shape of the first vessel.

7. The fluid mixing system of claim 1, wherein the media introduction port is disposed along the first fluid conduit.

8. The fluid mixing system of claim 1, wherein the mixer comprises a reusable portion and a disposable portion.

9. The fluid mixing system of claim 8, wherein the reusable portion of the mixer comprises a driving unit and wherein the disposable portion of the mixer comprises a pump head.

10. The fluid mixing system of claim 7, wherein the pump head comprises an impeller driven by the mixer to provide a homogenous dispersion of an additive in the fluid with a 2x fold increase of a concentration of the additive to the fluid in no greater than 60 seconds of mixing compared to a starting concentration and a homogenous dispersion of the additive in the fluid with a 4x fold increase of the concentration of the additive to the fluid in no greater than 120 seconds of mixing compared to the starting concentration, as measured according to a Mixing Test.

11. A fluid mixing system comprising:

a first vessel defining an interior volume adapted to receive a second vessel;

a mixer disposed outside of the first vessel and adapted to be in fluid communication with an interior volume of the second vessel, wherein the mixer comprises a reusable portion and a disposable portion, wherein the mixer is coupled to the second vessel by a first fluid conduit extending between an outlet of the second vessel and the mixer and a second fluid conduit extending between an inlet of the second vessel and the mixer; and a media introduction port for introduction of a media into a fluid in the fluid mixing system, wherein the media introduction port comprises a venturi, the media introduction port disposed on the first fluid conduit, the second fluid conduit, or combination thereof.

12. The fluid mixing system of claim 11, wherein the second vessel, at least a portion of the mixer, and the conduits extending between the second vessel and the mixer form a closed-unit, disposable mixing assembly.

13. The fluid mixing system of claim 11, wherein the media introduction port is disposed along the first fluid conduit.

14. The fluid mixing system of claim 11, wherein the reusable portion of the mixer comprises a driving unit and the disposable portion of the mixer comprises a pump head.

15. A fluid mixing system comprising:

a disposable vessel including an inlet and an outlet;

a disposable portion of a mixer disposed outside of the disposable vessel, the disposable portion of the mixer adapted to couple with a reusable portion of the mixer;

a first fluid conduit extending between the inlet of the disposable vessel and the disposable portion of the mixer;

a second fluid conduit extending between the outlet of the disposable vessel and the disposable portion of the mixer; and a media introduction port for introduction of a media into a fluid in the fluid mixing system, wherein the media introduction port comprises a venturi, the media introduction port disposed on the first fluid conduit, the second fluid conduit, or combination thereof, wherein the fluid mixing system is adapted for single use, wherein the fluid mixing system is adapted to be used with a reusable vessel, and wherein the reusable portion of the mixer is coupled to the reusable vessel.

16. The fluid mixing system of claim 15, wherein the disposable vessel is adapted to be positioned within the reusable vessel prior to a mixing operation.

17. The fluid mixing system of claim 15, wherein the disposable vessel, at least a portion of the disposable portion of the mixer, and the conduits extending between the disposable vessel and the disposable portion of the mixer form a closed-unit, disposable mixing assembly.

18. The fluid mixing system of claim 17, wherein the closed-unit disposable mixing assembly is removable from the reusable vessel as a single piece.

* * * * *